US007779763B2

(12) United States Patent
Valentinsson

(10) Patent No.: US 7,779,763 B2
(45) Date of Patent: Aug. 24, 2010

(54) TRANSPORT PALLET

(75) Inventor: Anders Lenart Valentinsson, Färlöv (SE)

(73) Assignee: Schoeller Arca Systems Services GmbH, Pullach (DE)

( * ) Notice: Subject to any disclaimer, the term of this patent is extended or adjusted under 35 U.S.C. 154(b) by 0 days.

(21) Appl. No.: 11/959,899

(22) Filed: Dec. 19, 2007

(65) Prior Publication Data

US 2008/0210140 A1 Sep. 4, 2008

Related U.S. Application Data

(63) Continuation-in-part of application No. 11/818,751, filed on Jun. 15, 2007, which is a continuation-in-part of application No. 11/641,240, filed on Dec. 19, 2006, application No. 11/959,899, which is a continuation-in-part of application No. 11/641,240, filed on Dec. 19, 2006.

(51) Int. Cl.
*B65D 19/38* (2006.01)

(52) U.S. Cl. ..... 108/57.25; 108/55.1

(58) Field of Classification Search ..... 108/57.25, 108/51.11, 901, 902, 55.1, 55.3; 248/346.02, 248/346.05; 206/595, 596, 598, 599, 600
See application file for complete search history.

(56) References Cited

U.S. PATENT DOCUMENTS 3,964,400 A * 6/1976 Brand ..... 108/57.25
4,051,787 A 10/1977 Nishitani et al.
4,287,836 A * 9/1981 Aoki ..... 108/57.25
5,555,820 A * 9/1996 Shuert ..... 108/57.25
5,989,706 A * 11/1999 McGinniss et al. ..... 428/341
6,237,509 B1 * 5/2001 Ishido et al. ..... 108/57.25
6,305,301 B1 * 10/2001 Piper et al. ..... 108/57.25
6,352,039 B1 * 3/2002 Woods et al. ..... 108/57.25
6,386,118 B1 * 5/2002 Bendit et al. ..... 108/57.25
6,508,182 B1 * 1/2003 Smorgan et al. ..... 108/57.28
6,668,735 B2 * 12/2003 Cassina ..... 108/57.25
6,758,148 B2 7/2004 Torrey et al.
6,840,181 B2 * 1/2005 Smyers ..... 108/56.1
6,928,933 B2 * 8/2005 Grau ..... 108/57.25
6,986,309 B2 * 1/2006 Sugihara et al. ..... 108/57.25
7,086,339 B2 * 8/2006 Apps et al. ..... 108/57.25
7,216,592 B2 5/2007 Krech et al.
2004/0168618 A1 9/2004 Muirhead
2005/0145145 A1 * 7/2005 Ogburn et al. ..... 108/57.25
2006/0075939 A1 * 4/2006 Shuert ..... 108/57.25
2006/0201401 A1 * 9/2006 Moore et al. ..... 108/57.25
2006/0201402 A1 9/2006 Moore, Jr. et al.
2007/0000415 A1 1/2007 Moore, Jr.
2008/0053342 A1 3/2008 Muirhead

* cited by examiner

*Primary Examiner*—José V Chen
(74) *Attorney, Agent, or Firm*—Van Dyke, Gardner, Linn & Burkhart, LLP

(57) ABSTRACT

A pallet for the movement of goods includes several individual parts connected to one another, including an upper section and a frame section. The upper section includes a plurality of openings, which are located in recesses formed in the underside of the upper section, which help the escape of heat through the pallet. The pallet may be formed from a fire retardant material and may be certified to comply with the Underwriters Laboratories, Inc. Standard 2335 "Fire Tests of Storage Pallets." The pallet may include a transponder for locating the pallet.

21 Claims, 18 Drawing Sheets

E-E

F - F

G

K

B - B

E - E

TRANSPORT PALLET

CROSS REFERENCE TO RELATED APPLICATIONS

The present application is a continuation-in-part of U.S. patent application Ser. No. 11/641,240, filed Dec. 19, 2006 TRANSPORT PALLET; and U.S. patent application Ser. No. 11/818,751, filed Jun. 15, 2007 by Valentinsson for TRANSPORT PALLET, which are hereby incorporated herein by reference in their entireties

FIELD OF THE INVENTION

The present invention relates generally to a pallet for the movement of goods.

BACKGROUND OF THE INVENTION

For the transport of goods, transport pallets, especially Euro pallets, are well-known, which are traditionally made of wood. Furthermore, pallets manufactured from plastic are also common, which, in addition to having a low weight, have better resistance to aging and are better to clean in comparison to wood. Many well-known pallets, however, have a relatively low torsional rigidity. They therefore cannot be readily subjected to asymmetric heavy loads. This reduces the scope of application. Furthermore, the problem arises in the case of plastic pallets that the plastic is flammable such that, in the event of a fire, toxic gases can develop. This, too, leads to a fundamentally undesirable restriction on the pallet's scope of application.

The object of the present invention is to create a pallet whose scope of application is increased.

SUMMARY OF THE INVENTION

According to an aspect of the present invention, a transport pallet has an upper section and a frame section, wherein the upper section has a loading part with loading surface. The frame section generally corresponds to the size of the loading surface and, at least at its corners, has spacers which point toward the upper section and via which the frame section is connected to the upper section. The upper section includes a plurality of transverse openings extending therethrough, and the underside of the upper section includes a plurality of recesses formed therein. The openings are aligned in the recesses, with the recesses directing the flow of gas through the openings to provide ventilation through the pallet.

In one aspect, the openings comprise slots having a length greater than their widths. Further, one group of slots may have greater lengths than other slots and/or greater widths than other slots. In addition, the slots may be arranged with a first group arranged in a plurality of parallel rows, with second group of slots arranged in a plurality of rows that are perpendicular to the rows of the first group. Optionally, the first group may be arranged outside the second group and further with the outer most slots in the second group form a perimeter group of slots.

In a further aspect, the slots may be arranged in four groups, one group in each quadrant of the upper section.

Alternately, the slots may be arranged in first and second groups of parallel rows, which transverse the loading part from one side to the other, and in third, fourth, fifth and sixth groups of parallel rows that are arranged along the sides orthogonal to the first and second groups of parallel rows.

In another aspect, the upper section may also have a plurality of handle openings. Expediently, the connection from the loading part to the reinforcement section in the area of the handle openings is a material-fit connection. To prevent workers from hurting their hands when handling the pallet, the handle openings arranged in the upper section may be rounded.

In a further aspect, the slots may be located between and inwardly from the handle openings or may be arranged between and around the handle openings.

Furthermore, handle recesses may be provided with reinforcement. These are expediently arranged at a slight distance from the side wall at which the reinforcement is molded on. The handle recesses comprise an indentation, which is at least as wide as a human hand, for example.

In other aspects, the frame section includes a frame center section and a frame floor section, which likewise have a material-fit connection to one another. Furthermore, the frame center section includes the spacers which point toward the upper section and via which the frame center section is connected to the upper section.

In yet other aspects, the upper section has a reinforcement section that has a material-fit connection with the loading part at their end faces. Further, the spacers have elevations which are inwardly offset in steps. For accommodating these elevations, the reinforcement section has recesses at its lower surface. The frame center section likewise has a material-fit connection to the reinforcement section in the area of the end-face spacers. Alternatively or additionally, the aforementioned connection can be in the area of the elevations.

The upper section and the frame section may be made from plastic, especially an elastomer plastic, with a material such as polypropylene or polyethylene suitable for use. Parts made from such a plastic lend themselves readily to material-fit connections and are also hygienic and easy to clean, in comparison with pallets formed from wood. The aforementioned connections between the parts are of a material-fit type effected by a welding method, with hot-plate welding especially suitable. Hot-plate welding is one of those heating element welding methods in which heating elements heat the contact area to be welded until the material in the areas concerned softens, and then the heating elements are removed from the heated area. The components to be welded are then positioned against each other and aligned with each other under compressive force. Material in the area to be welded deforms fluidly and, in flowing, creates the material connection. Heating may be performed not as far as the melting point of the plastic, but only to above the softening point.

Additionally, the pallet may be formed from a fire retardant material, which may comprise a polymer, plastic or resin having a fire retardant additive. Further, with the increased ventilation provided by the openings in the loading part, the pallet may enhance the release of heat so that when a fire condition occurs, which would allow the sprinklers in the area to detect the heat fastener than they would otherwise with a pallet with a solid deck. Further, the openings in the top deck allow the water from the sprinklers to flow through pallets, thus enhancing water distribution.

In addition, the pallet in accordance with the invention may be substantially torsionally stiffer than well-known pallets, because the upper section and the frame section reinforcing it are much better connected to one another. This increases its scope of application such that it is more economically applicable. Further, the pallet may have a high torsional rigidity and also be adapted to support asymmetrical loads.

The following drawings show the preferable embodiment, without limiting the inventive idea expressed in the claims.

These and other objects, advantages, purposes and features of the present invention will become apparent upon review of the following specification in conjunction with the drawings.

DETAILED DESCRIPTION OF THE DRAWINGS

Figure 1:
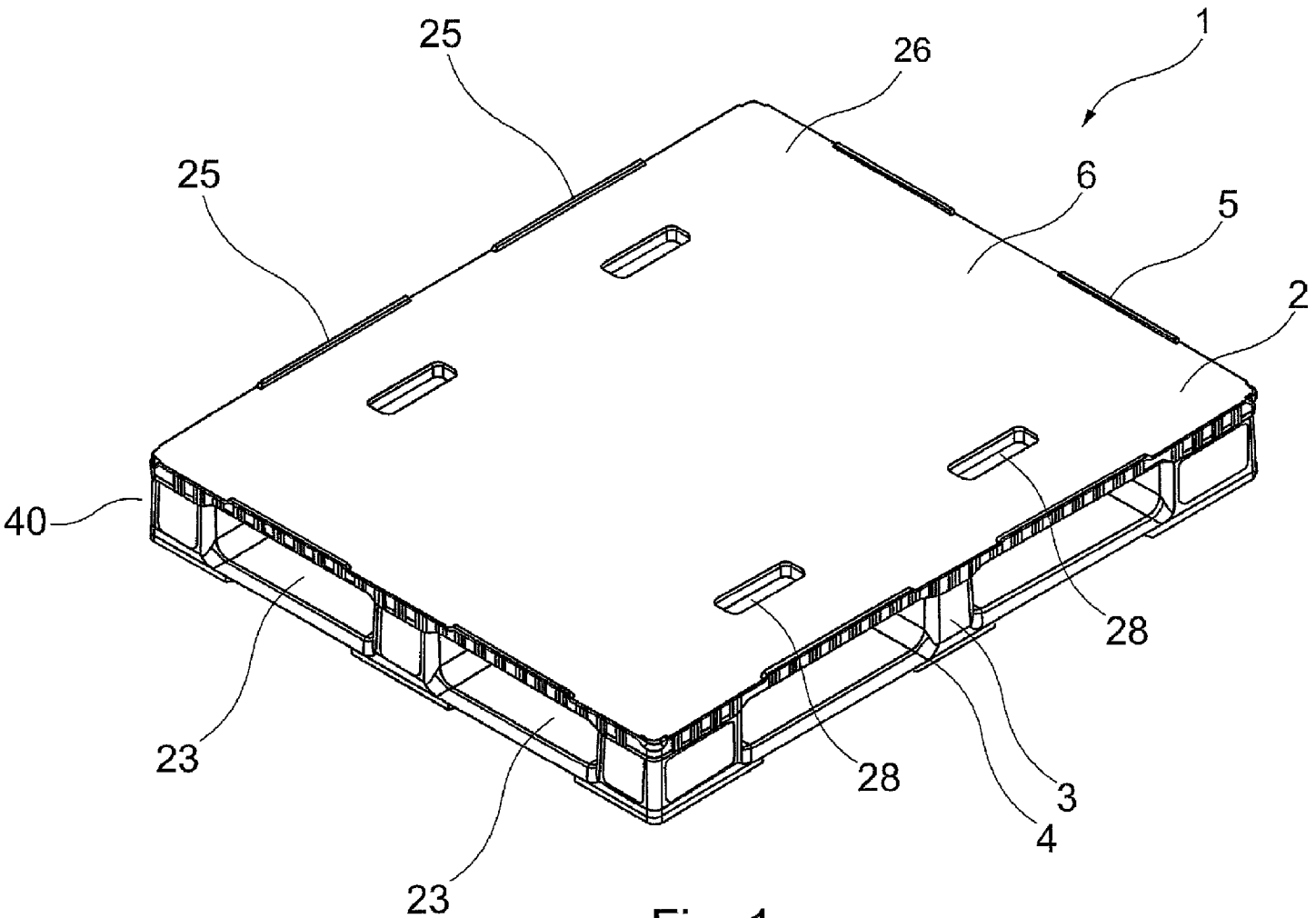
FIG. 1 is a three-dimensional view of the pallet in the position of normal use, wherein the loading surface points upward.

Referring now to the drawings and the embodiments illustrated therein, FIG. 1 is a three-dimensional view of a pallet in accordance with the invention, whose loading surface 26 points upward. In the following, it is this definition of the direction which is referred to. The loading surface 26 is an area of the loading part 6, which, together with the reinforcement section 5, forms the upper section or top deck 2 of the pallet 1. Underneath the upper section 2 is arranged the frame section 40, which comprises the frame center section 3 and the frame floor section or lower portion 4. The frame section 40 has a rectangular basic structure, which corresponds roughly in size to the loading surface 26, and in this basic structure are provided four wide, window-like breakthroughs, such that the frame section 40 has essentially four external struts and a central crosspiece 42, as evident in FIG. 2. Underneath the frame center section 3 is the frame floor section 4, which is connected to the frame center section 3 and has a platform for the surface. Stiffening profiles 7*a*, 7*b* are accommodated in the area between frame center section 3 and frame floor section 4.

Upper section 2 has four handle openings 28, which are long enough and wide enough for a worker to put in a hand to comfortably lift the unloaded pallet. The alignment of the handle openings 28 in their length corresponds to the longitudinal direction of the rectangular pallet 1. The handle openings are arranged at the edge of the upper section 2. Alternately, the pallets may be transported using either a hand pallet truck or a fork lift truck. The pallet may include a cruciform bottom deck, which is designed for four-way entry by a fork lift or hand pallet truck. The pallet may also include chamfered skids for easy access by such a truck. Further, the top deck of the pallet may include anti-slipping rims 25 which prevent sliding or shifting of the load from the pallet during transport.

Figure 3:
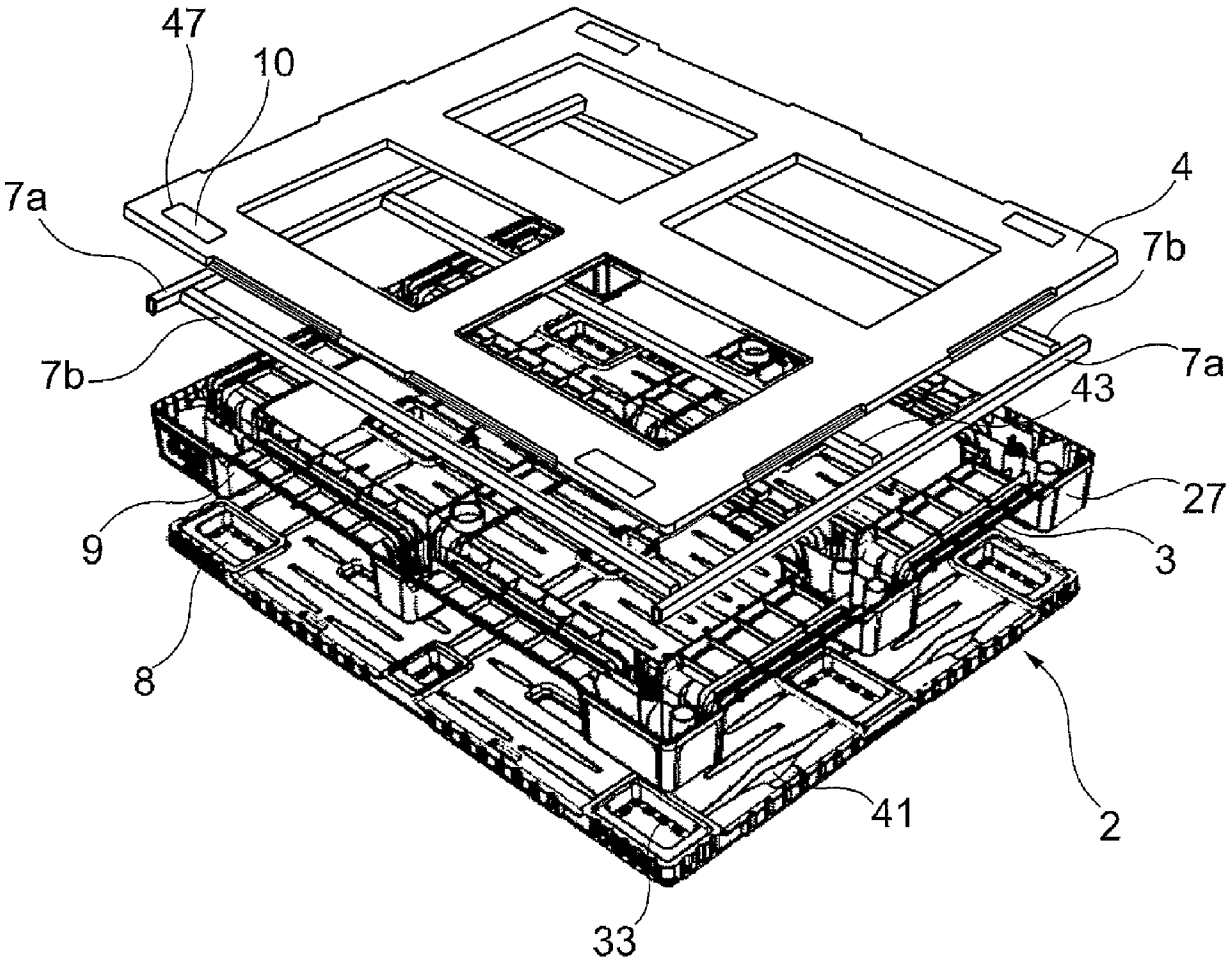
FIG. 3 is a partly exploded view of the pallet, in which the reinforcement piece and loading part are not exploded toward each other.

As is evident from FIG. 3, the upper section 2 is of uniform thickness, which is created by the distance from the loading part 6 to a parallel arranged base surface of the reinforcement section 5. To increase the stiffness and decrease the weight of the pallet, upper section 2 may be formed from two sheets or twin sheets of material, as opposed to being a solid section. At the sides of this base surface are provided essentially perpendicularly arranged edges, which point toward the loading part 6 and are connected to this. Viewed in this way, the reinforcement section 5 has a tub-shaped basic structure, with the open side of the tub limited by the loading part 6. At the outer peripheral contact area between reinforcement section 5 and the loading part 6 are provided areas upon which the loading part 6 on the reinforcement section 5 rests. In other words, the contact surface here is horizontally aligned such that gravity forces from goods present on the loading part 6 are transmitted directly to reinforcement section 5 via compressive forces. These areas are arranged at the corners of the pallet and at the center of their sides. On areas located between them are arranged anti-slipping rims 25, which are a component of the reinforcement section 5, arranged such that they terminate above the loading area 26. The contact surface between the reinforcement section 5 and the loading part 6 has a vertical alignment there. The loading surface 26 is limited at each of its sides by two anti-slipping rims 25.

In FIG. 3, it is clear that the reinforcement section 5 comprises a plurality of reinforcement section ribs 41, which, starting from the base surface of the reinforcement section 5, point toward to the loading part 6, have a longitudinal extension and are in contact with the loading part 6. At the contact areas between the loading part 6 and the reinforcement section 5 is provided a material-fit connection, a fact which means that the material of both parts is welded in these areas. Through the welds, the loading part 6 and the reinforcement section 5 enclose an area, which is designed to be dampproof.

The reinforcement section offers the pallet substantial stability when stacked, without damaging the load. Additionally, the reinforcement section may be at least partially formed from steel and may increase the load capacity of the pallet. For example, a pallet in accordance with the present invention is adapted for supporting a flat static load up to 30,000 pounds, a flat dynamic load up to 5,000 pounds or a flat racking load up to 2,800 pounds. A pallet having this load capacity may be generally rectangular and may have external dimensions of a length of approximately 48 inches, a width of approximately 40 inches and a height of approximately 5-6 inches. Such a pallet may have a weight of approximately of 48-49 pounds.

Figure 2:
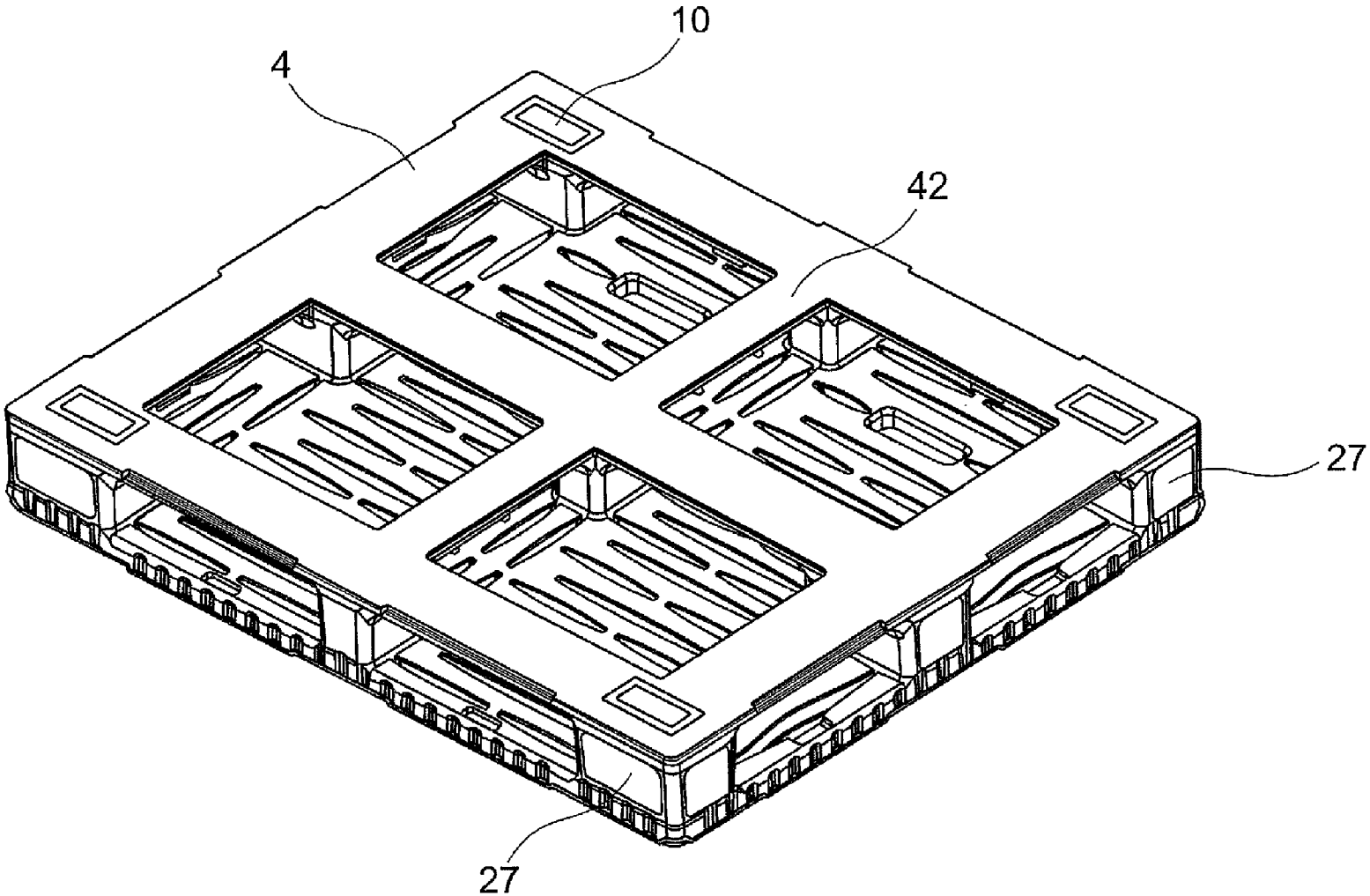
FIG. 2 is a corresponding three-dimensional lower view of the pallet.
Figure 10:
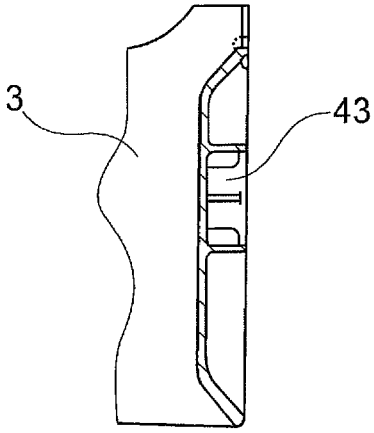
FIG. 10 is a cross-sectional view on the line E-E of FIG. 5.
Figure 11:
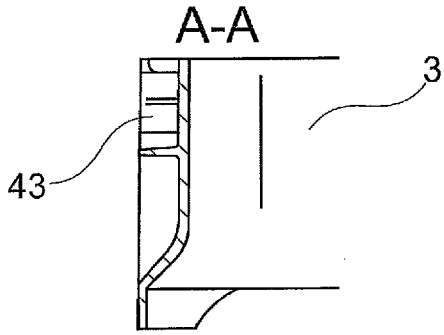
FIG. 11 is a cross-sectional view on the line A-A of FIG. 5.
Figure 12:
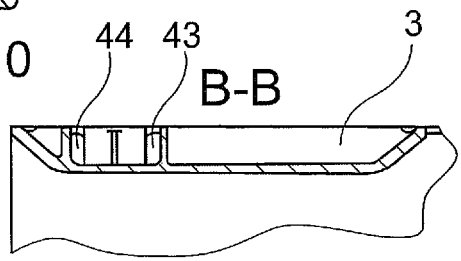
FIG. 12 is a cross-sectional view on the line B-B of FIG. 5.
Figure 18:
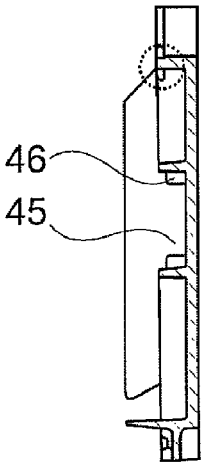
FIG. 18 is a cross-sectional view on the line B-B of FIG. 15.
Figure 20:
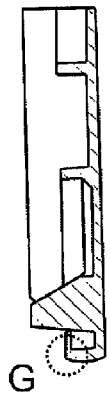
FIG. 20 is a cross-sectional view on the line E-E of FIG. 15.

The view of the lower side of the pallet in FIG. 2 clearly shows the central crosspiece 42 of the frame section 40. It extends centrally in the frame, which is spanned by the four corners of the pallet 1. The central crosspiece 42 as well as the lower area of the frame section 40 are formed from the frame center section 3 and the frame floor section 4. As FIG. 3 shows, in areas between the frame floor section 4 and the frame center section of 3 are arranged two stiffening profiles 7*a* and three stiffening profiles 7*b*, with two each of the profiles 7*a* and 7*b* in the outside edges of the framework and a profile 7*b* in an axis of the central crosspiece 42. The stiffening profiles 7*a* and 7*b* are manufactured from a rectangular steel section. At the lower side at the frame center section 3 are provided center section profile recipients 43, which are U-shaped. As shown in FIGS. 10, 11 and 12, center section profile recipients 43 are roughly the width of the stiffening profiles 7*a* or 7*b* and half their height. Each of the stiffening profiles 7*a* and 7*b* is fitted into the profile recipient 43 such that approximately half of the height projects above the center section profile recipient 43 and is accommodated in a profile recipient 45—see FIG. 18—of the frame floor section 4. Furthermore, for the purpose of lateral guidance of the stiffening profiles 7*a*, 7*b*, ribs 46 are molded on at the frame center section ribs 44 and at the frame floor section, said ribs 46 limiting the lateral mobility of the profiles. Since the ribs 44 deform flexibly when the stiffening profiles 7*a* and 7*b* are joined to the frame center and floor sections, the stiffening profiles are accommodated without any play and so can easily accommodate twisting of the pallet and thus support the rigidity of the pallet. Additionally, the frame center and floor sections are aligned relative to each other via the stiffening profiles 7*a* and 7*b* during joining in the production process.

Figure 4:
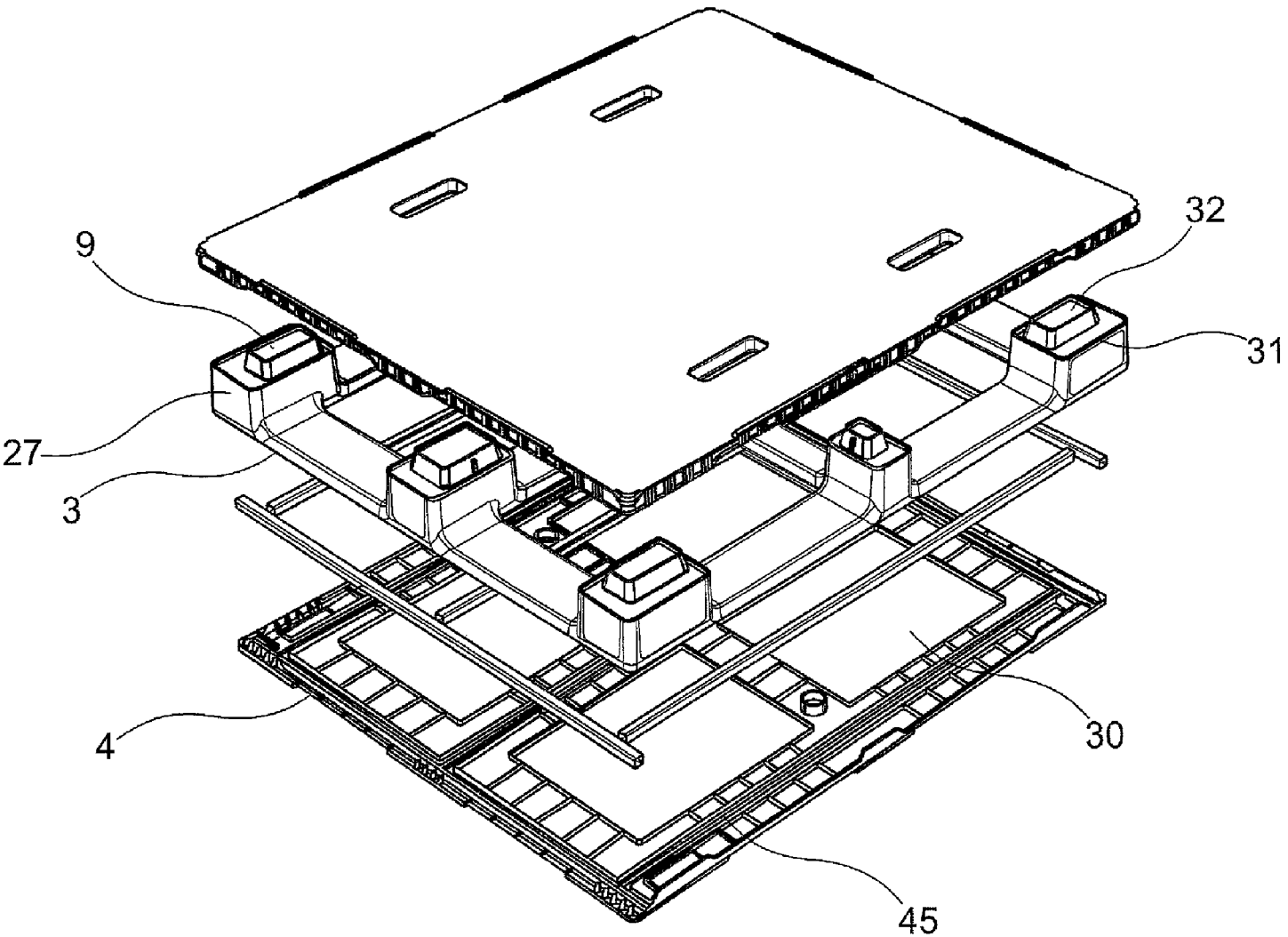
FIG. 4 is a rotated view of the exploded view in accordance with FIG. 3.
Figure 6:
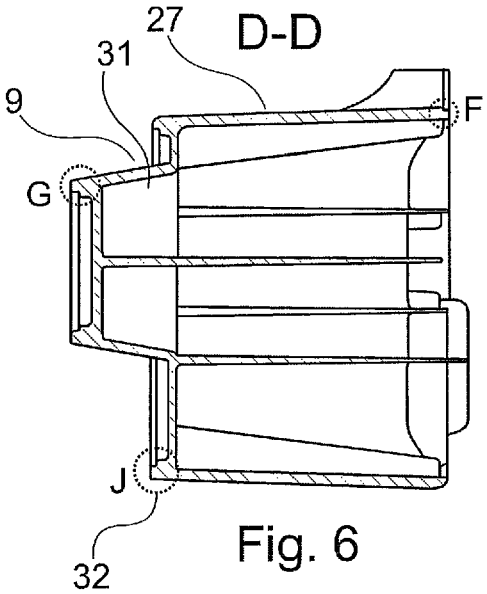
FIG. 6 is a cross-sectional view on the line D-D of FIG. 5 through one of the elevations 9.

In the illustrated embodiment, nine spacers 27 are molded on at the frame center section 3. The spacers contact its four corners, four centers of its outside edges and the center of its surface. As evident from FIG. 4 or FIG. 6, provided at the spacers 27 are elevations 9, which are present at an end face of the spacers and are inwardly offset stepwise. Both the spacers 27 and the elevations 9 are essentially rectangular, with the length and width of the elevations 9 smaller than those of the spacers 27. FIG. 6 shows that the elevation 9 has a truncated pyramid extension. Reinforcement piece 5 has corresponding recesses 8, in which the elevations 9 are accommodated. Here, the truncated pyramid shape facilitates joining of the frame center section to the reinforcement section in the manufacturing process, since both parts position themselves relative to each other via the diagonal edge.

As shown in FIGS. 4 and 6, first welding ribs 31 are molded on at the spacer 27, and second welding ribs 32 are molded on at the end of the elevation 9. In the illustrated embodiment, both the first and second welding ribs are each molded on at the end-face outside edges of the spacer 27 and the elevations 9. During welding of frame center section 3 to the upper section 2, the ribs 31 and 32 are heated to the softening point, then the two parts are joined to each other. During joining, mechanical pressure is exerted on the first and second welding ribs 31 and 32, such that these ribs deform fluidly, such that this flow creates a material-fit connection between the two parts. This process is supported by third welding ribs 33, which are shown in FIG. 3. The third welding ribs 33 are at the base of the recesses 8 and make contact with the second welding ribs 32 during joining. Since the third welding ribs 33, unlike the second welding ribs 32, are not formed continually around the periphery, but project from area to area, the material of the second welding ribs 32 can flow around the third welding ribs 33 during joining, whereby the strength of the welded joint can be improved.

Figure 5:
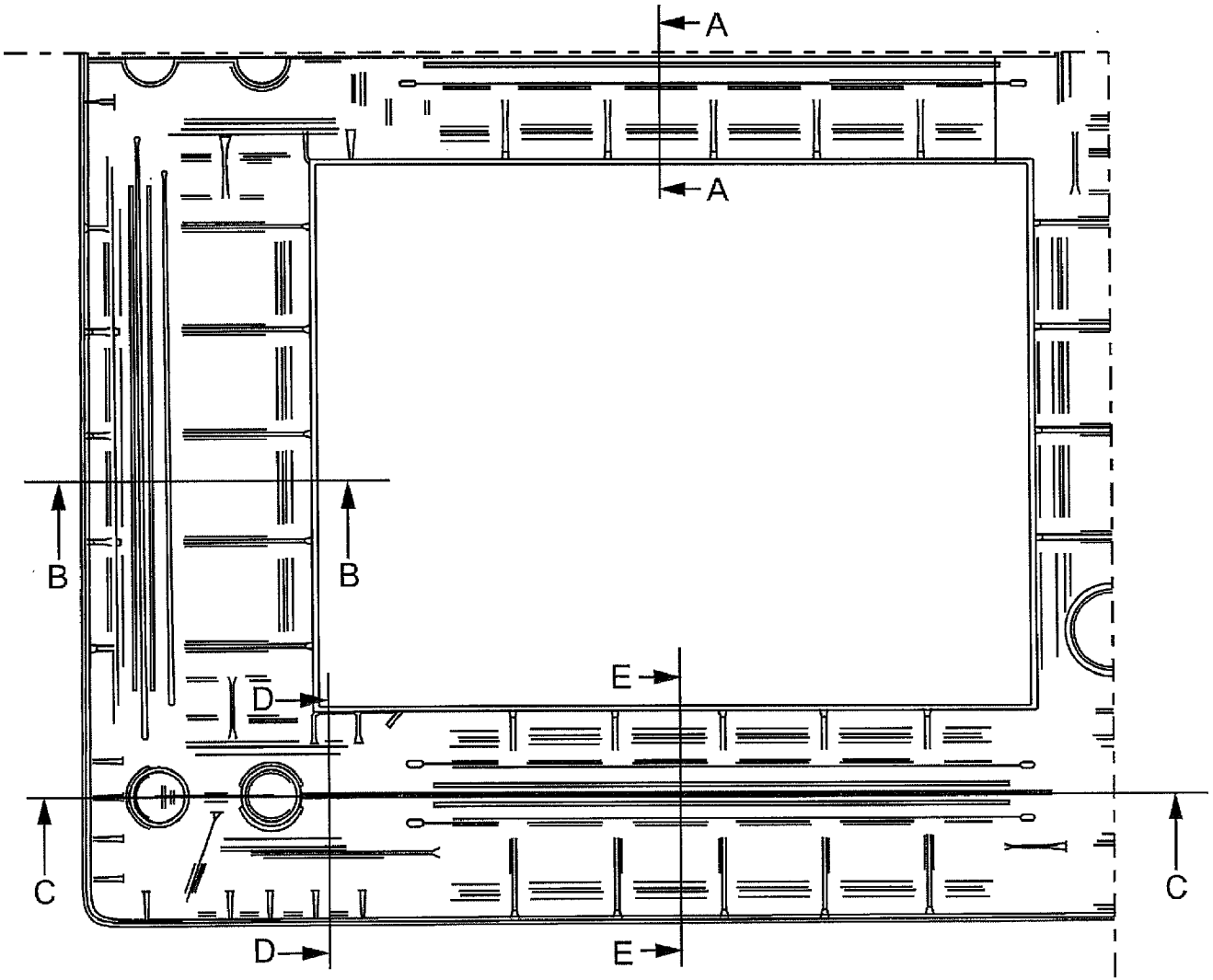
FIG. 5 is a plan view of a quarter of the frame center section, with the lower right corner shown.

FIG. 5 shows a plan view of the lower right corner of the frame center section 3, which shows only one of the four windows of the frame center section 3. In the lower right corner of FIG. 5 is shown a plan view 5 of the spacer 27, which, in cross-sections along lines D-D, in accordance with FIG. 6, and C-C, in accordance with FIG. 5, is shown in detail in both side views.

Figure 7:
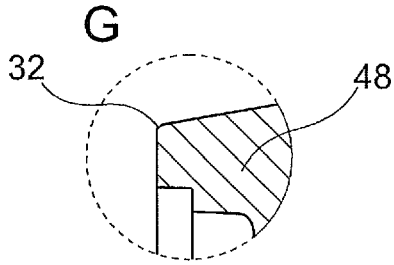
FIG. 7 is a detailed view of FIG. 6 with the representation of the second welding ribs.
Figure 9:
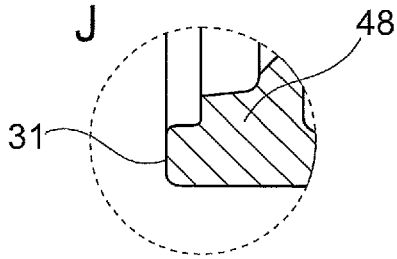
FIG. 9 is a detailed view of the FIG. 6 of the first welding ribs.

FIGS. 7 and 9 show the shape of the welding ribs 32 and 31 in details G and J. At those areas where the ribs at the elevation 9 or the spacer 27 are molded on is provided one each of a material accumulation 48, which has a larger wall thickness than the corresponding welding rib 31 and 32. In the welding method, temperature control ensures that primarily the material of the welding ribs is softened. Since, in the area of the material accumulation 48, the heat supplied is insufficient to soften the material, during welding, this area, and thus also elevations 9 and the spacers 27, remain undeformed as far as possible and material softening is limited to the welding ribs.

Figure 8:
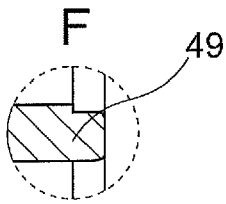
FIG. 8 is a detailed view of FIG. 6 of the welding ribs for welding of frame center section to the frame floor part.

In FIG. 8, a fourth welding rib 49 of the frame center section 3 is shown, which serves for welding to the frame floor section 4. Peripheral fourth welding ribs 49 are each arranged around one of the window-like break-throughs, such that the frame center section 3 and the frame floor section 4 at these welding seams can be connected to each other continuously and thus to be impermeable to damp.

Figure 13:
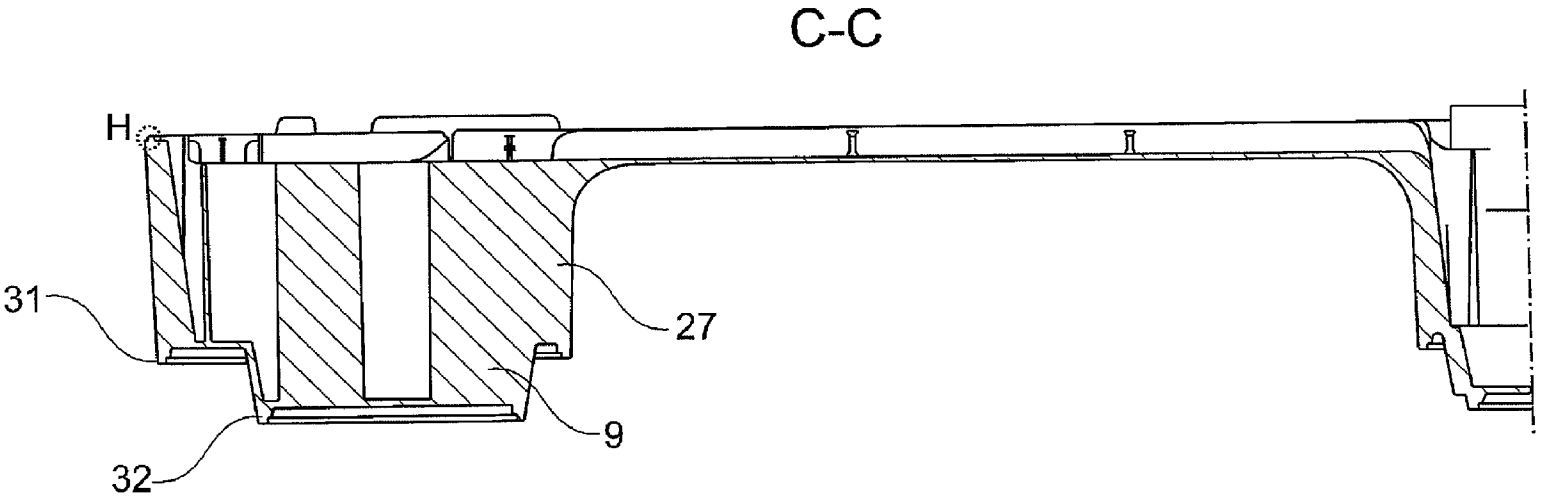
FIG. 13 is a cross-sectional view on the line C-C of FIG. 5.
Figure 14:
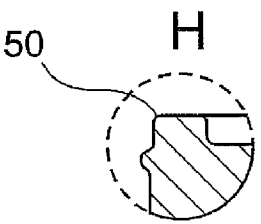
FIG. 14 is a detailed view of FIG. 13 of the welding ribs for welding the frame center section to the frame floor section.

FIGS. 11 and 12 show the cross-sections along lines A-A and B-B of FIG. 5 with a part of the frame of the frame section 40, the center section profile recipients 43 and corresponding ribs 44, which serve the purpose of guidance of the ribs shown. FIG. 13 shows a section through the frame center section 3, whose detail H in FIG. 14 shows a fourth welding rib 50. This is arranged peripherally at the outside edge of the frame center section 3 and makes for a dampproof weld to the frame floor section 4 in this area.

Figure 15:
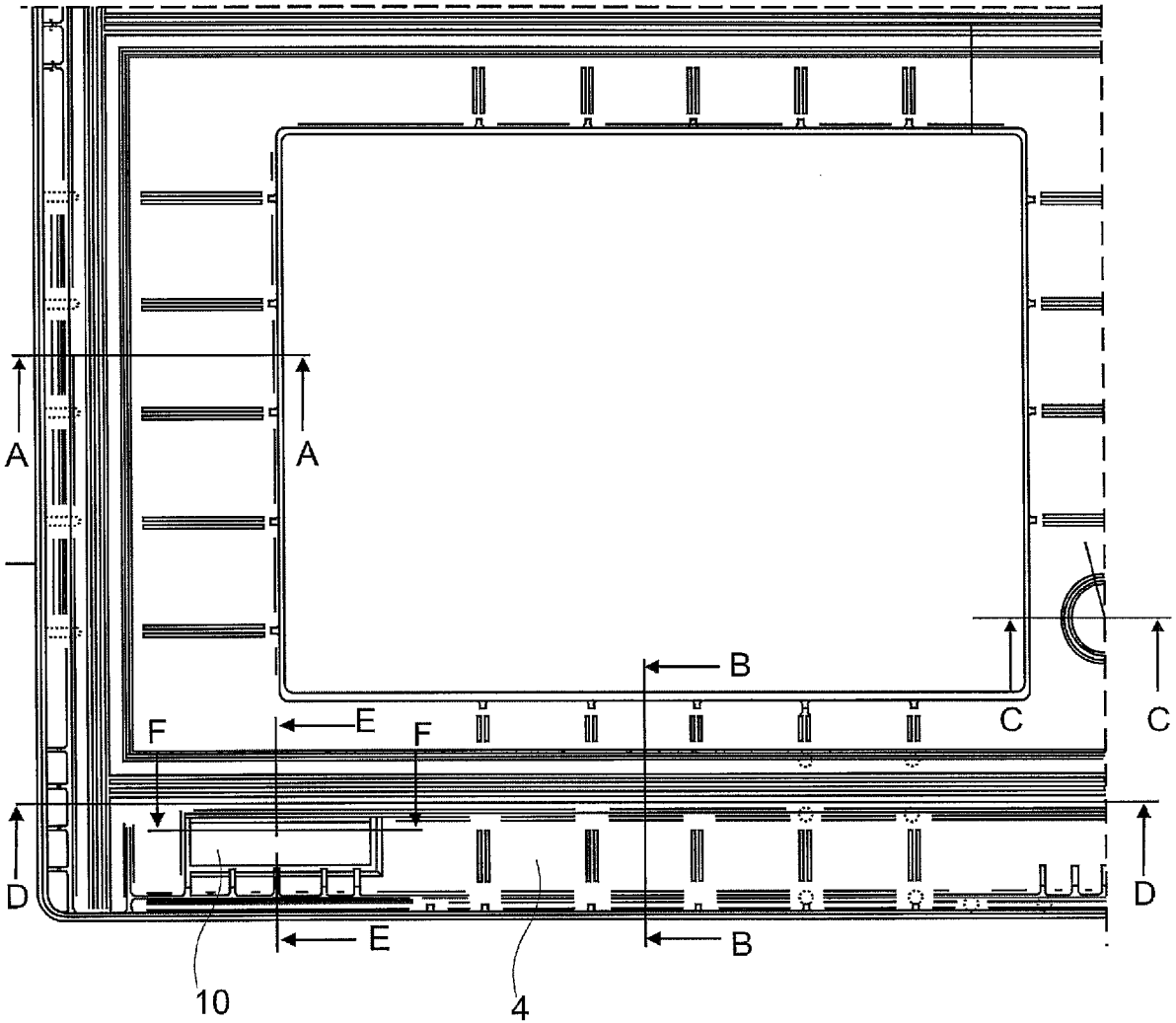
FIG. 15 is a plan view of a quarter of the frame center section, with the lower right corner shown.
Figure 16:
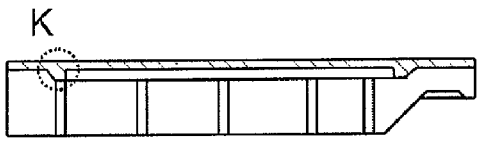
FIG. 16 is a cross-sectional view on the line F-F of FIG. 15.
Figure 19:
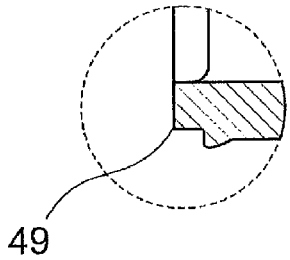
FIG. 19 is a detailed view of detail G of FIG. 20.
Figure 17:
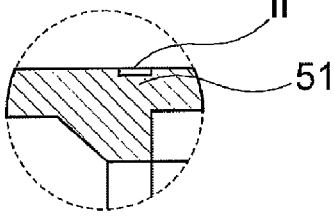
FIG. 17 is a detailed view of FIG. 16.

FIG. 15 shows a plan view of the lower right quarter of the frame floor section 4, and the section in accordance with FIG. 16 with the detail K in accordance with FIG. 17 shows a groove 47, which is molded on at the lower surface of the frame floor section 4. This groove 47 is rectangular, as shown in FIG. 3, and forms an area in which the wall thickness of the frame floor section 4 is reduced. This groove 47 thus delimits in other words a window 10, behind which extends toward the spacer 27 an inner space as transponder cavity 11, which is suitable for accommodating a transponder. Before the frame center section 3 is welded to the floor section 4, a transponder 51 is inserted into this transponder cavity 11, said transponder being then enclosed by welding so as to be dampproof. Only when, for example, a cut is made with a knife along the groove 47, is the window 10 opened, such that access to the inserted transponder is made possible. In this way, the transponder can be removed and replaced, for example. Then, plastic, such as a plastic foaming compound, can be used to seal the window again in order that harmful environmental influences may be kept at bay from the transponder. At each of the spacers 27, which lie at the corners of the pallet, is provided a transponder cavity.

Transponder 51, which is also known in the art as an RFID or RFID tag (radio-frequency identification), may be used as part of a wireless tracking and tracing system for locating, localizing and circulating or distributing the pallets. Transport pallets of the type disclosed herein may be used in pooling or rental systems, wherein the pallets are temporarily used by a customers and returned when the pallets are no longer needed. However, customers may lose track of the pallets in their possession. To ensure that pallets do not become lost or remain out of use for a significant period of time, a provider or service company which provides and circulates the pallets may use the transponder to determine the position and location of each pallet. Thus, the company supplying the pallets has access to the location of its entire supply chain of pallets, and can determine each of its customer's inventory of pallets. It can also be determined, based on the tracking data, whether the pallets are in use, i.e. being used to transport goods. If the transponders show that a customer has pallets that have remained stationary and that appear to be out of use, the pallets may be returned from the customer to the service company, cleaned, and again introduced into the transport process, and shipped to another customer in need of transport pallets.

To increase the number of industrial applications for which the pallet may be used, the pallet described herein may be formed from a fire retardant material. The fire retardant material may comprise a polymer or plastic or resin material, such as ethylene vinyl acetate, which may include a fire retardant additive. For example, the fire retardant additive may comprise a brominated flame retardant and/or an antimony trioxide synergist. Because the additives are encapsulated in a neutral polymer, they are not considered hazardous in this application and are acceptable for use in the production of packaging materials, including transport pallets in accordance with the present invention.

Figure 21:
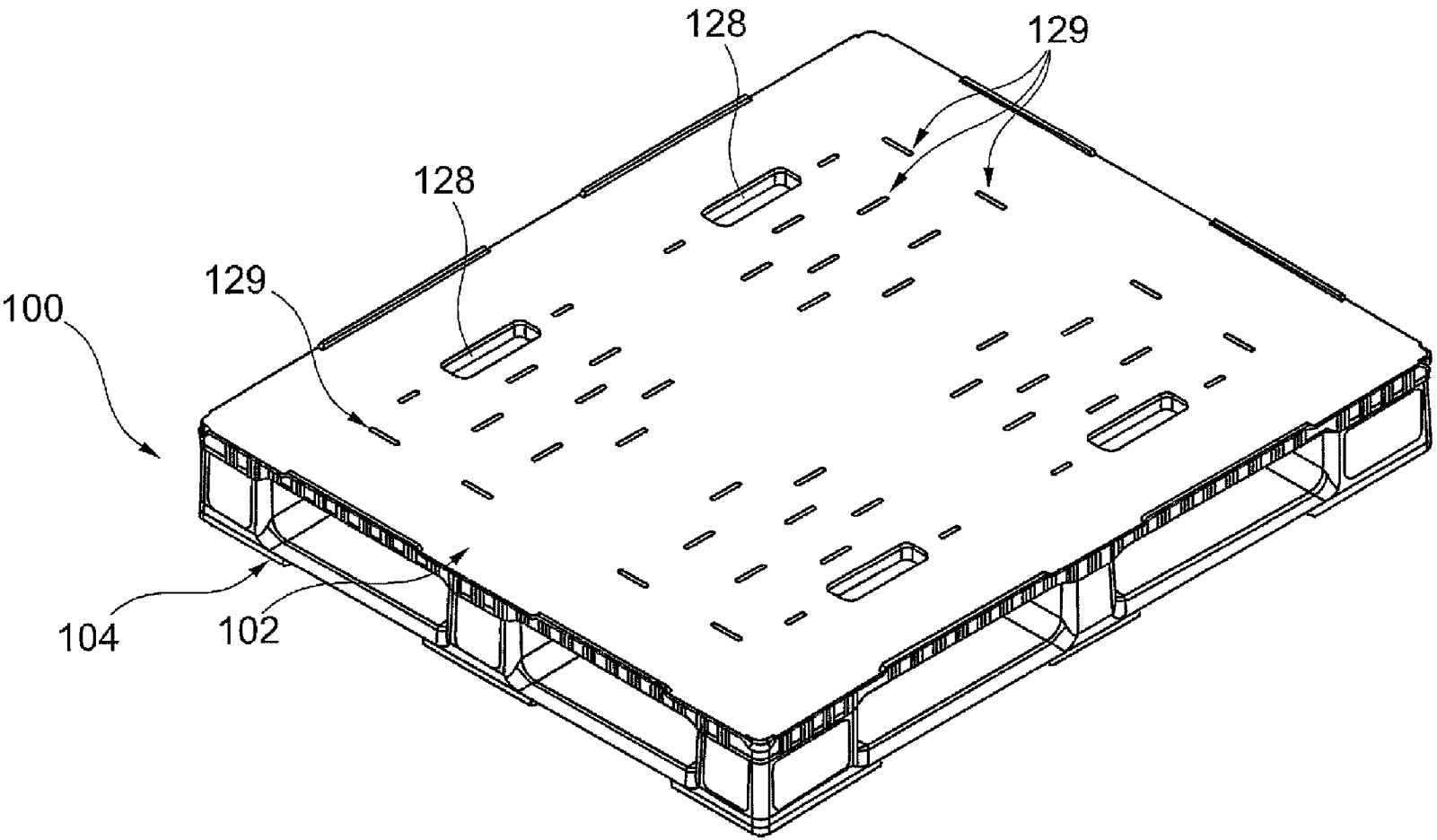
FIG. 21 is an upper perspective view of another embodiment of a pallet.

Referring to FIG. 21, the numeral 100 generally designates another embodiment of the pallet of the present invention. As will be more fully described below, pallet 100 is adapted to achieve improved ventilation and, further, optional simulate the structure of a wooden pallet so as to improve its performance in a fire setting at least from a ventilation perspective.

Figure 24:
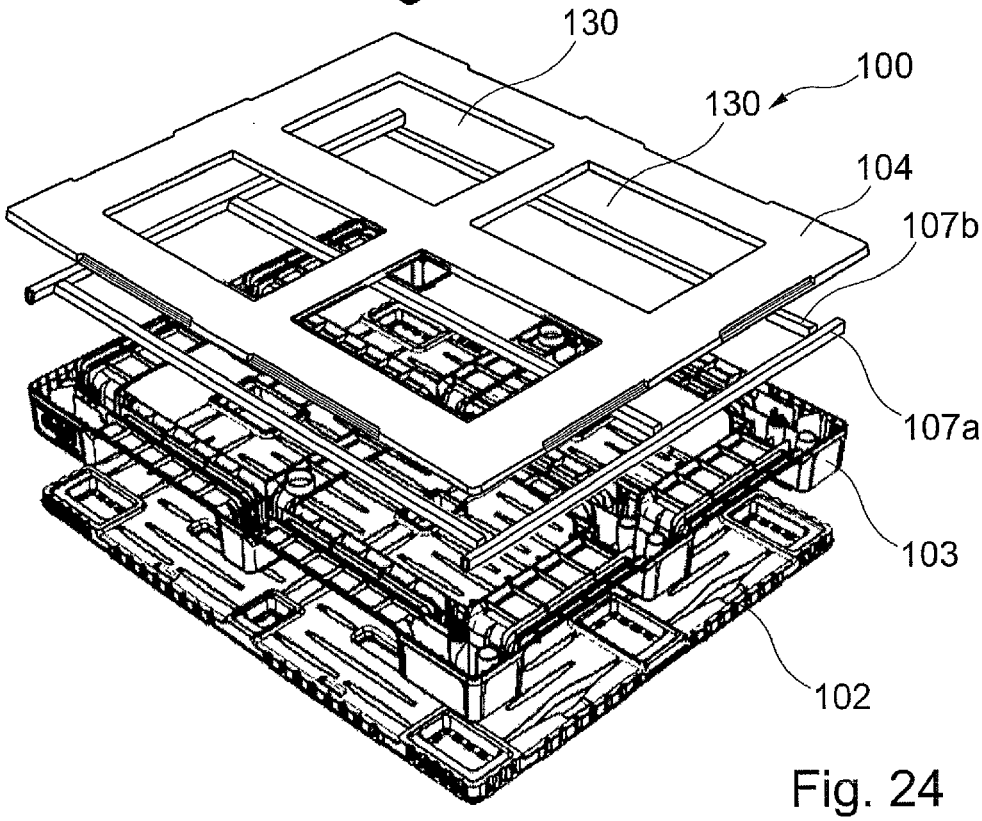
FIG. 24 is a bottom perspective exploded view of the pallet of FIG. 23.

As best seen in FIGS. 21 and 24, pallet 100 includes a plurality of openings, such as slots, to ventilate the pallet in the case of a fire. In the illustrated embodiment, pallet 100 includes an upper section or top deck 102, a frame floor section or lower portion 104, a frame center section 103 and stiffening profiles 107*a*, 107*b*. Top deck 102 may be constructed with a welded twin-sheet thermoforming process, while lower portion 104 may be formed from two components and may be injection molded. For further details for the general construction of pallet 100 reference is made to pallet 1.

Figure 23:
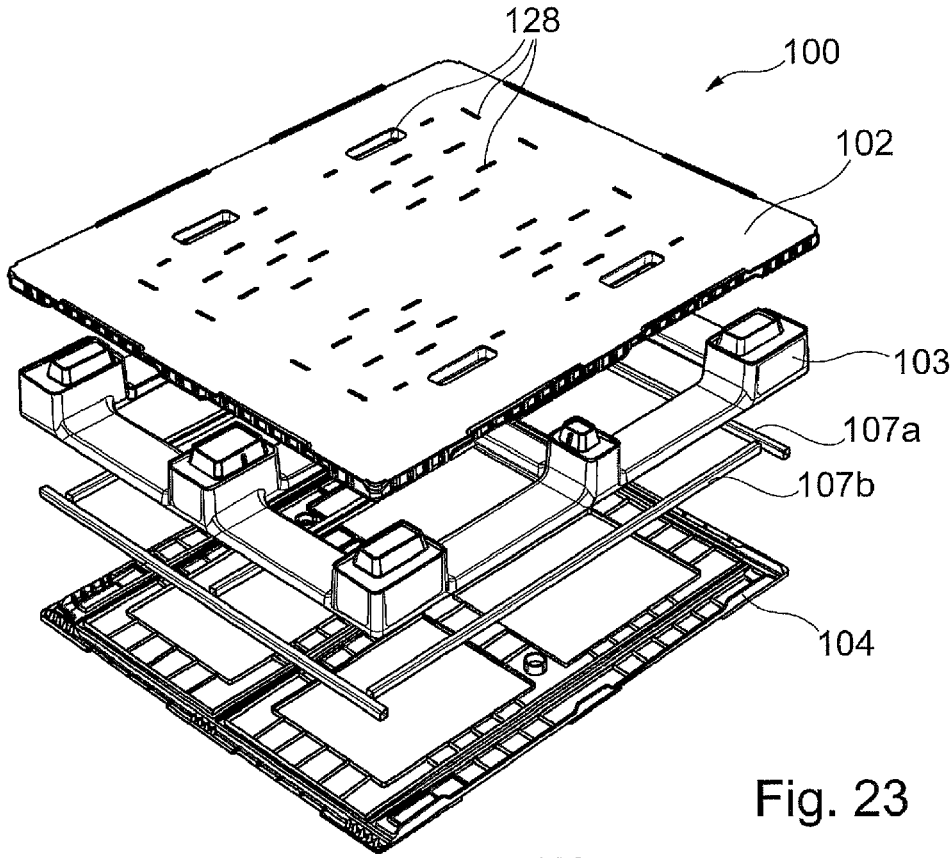
FIG. 23 is an upper perspective exploded view of a pallet of FIG. 21.
Figure 25A:
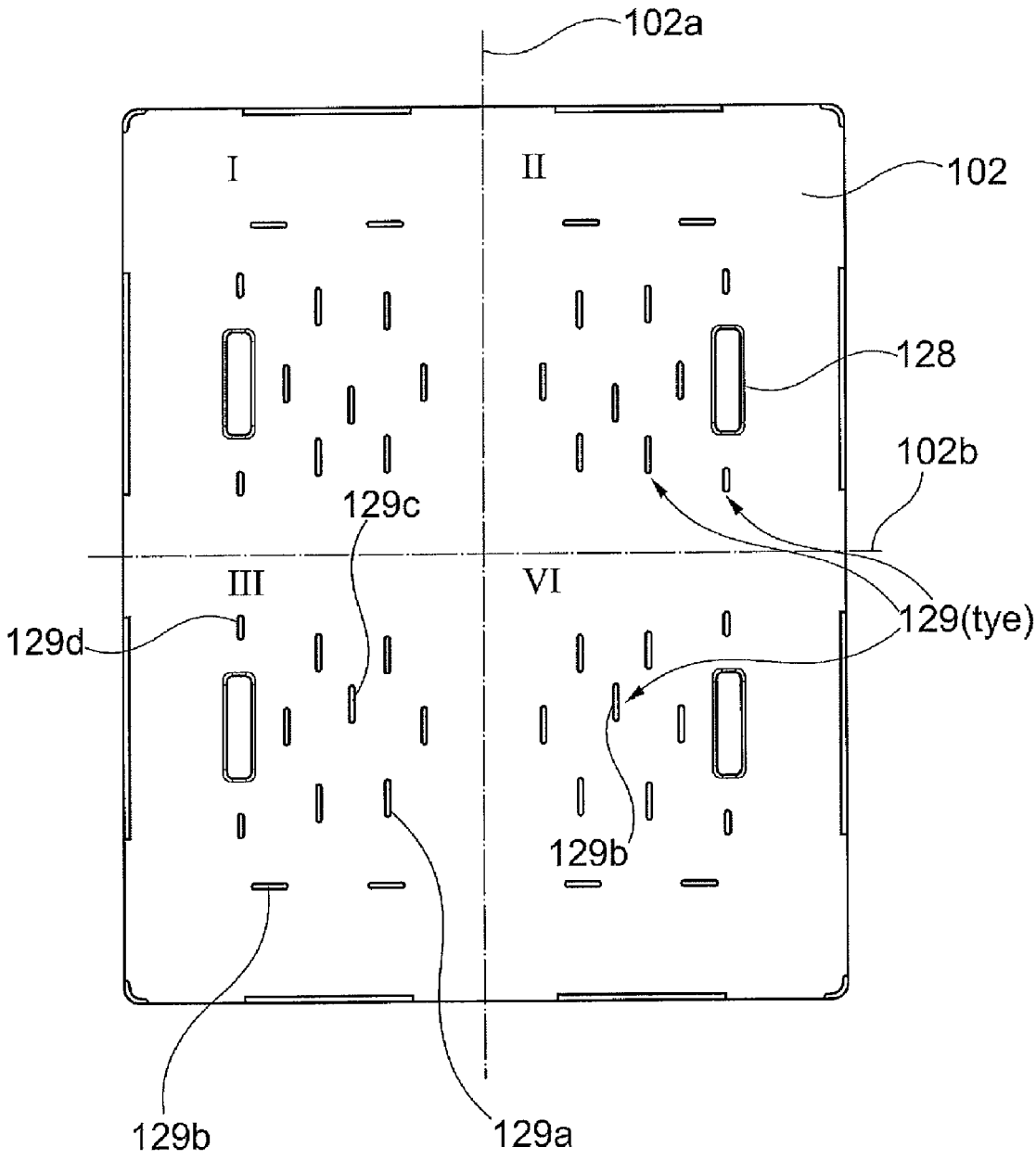
FIG. 25A is a top plan view of the pallet of FIGS. 21 and 22, showing the venting pattern of a top deck or upper section of the pallet.

Similar to pallet 1, top deck 102 may include a plurality of openings 128 configured for use as handholds. Further, top deck 102 includes a second plurality of opening 129, which are positioned or patterned to increase ventilation through pallet 100 (see the venting pattern of top deck 102 in FIG. 26). As shown in FIGS. 21, 23 and 24, opening 129 may comprise slots that are generally rectangular in shape with round ends and hence have greater lengths than widths. The slots, however, may vary in size and shape. For example, in the illustrated embodiment and as best seen in FIG. 25A, openings 129 include a first set of longer rectangular shaped slots 129*a*, which are arranged in rows generally parallel to the longitudinal axis 102*a* of deck 102, with some rows being offset from other rows. Similar slots 129*b* may also be arranged in rows that are generally parallel to the lateral axis 102*b* of deck 102. Further, openings 129 may include shorter but wider slots 129*c* that are also arranged with their longer dimensions aligned parallel to axis 102*a* similar to slots 129*a*. Slots 129*c* may located in the same group as slots 129*a* to form a repeating pattern, with each pattern repeated in the four quadrants labeled I, II, III, and IV of the top deck 102(FIG. 25A), with each quadrant having a handhold opening 128 associated herewith. Openings 129 may also include a fourth set of slots 129*d* which are shorter in length than slots 129*a*, 129*b* and 129*c* but approximately equal in width to slots 129*c*. Slots 129*d* are located on either side of handhelds 128 with their longer dimensions also arranged parallel to axis 102*a*.

Further, slots 129*a*, 129*c*, and 129*d* may be arranged in a plurality of parallel rows, with slots 129*b* arranged in a plurality of rows that are perpendicular to the rows of slots 129*a*, 129*c*, and 129*d*. Optionally, the slots 129*b* may be arranged outside the group of slots formed by 129*a*, 129*c*, and 129*d* with the outermost slots (129*d* and 129*b*) forming a perimeter group of slots.

Figure 22:
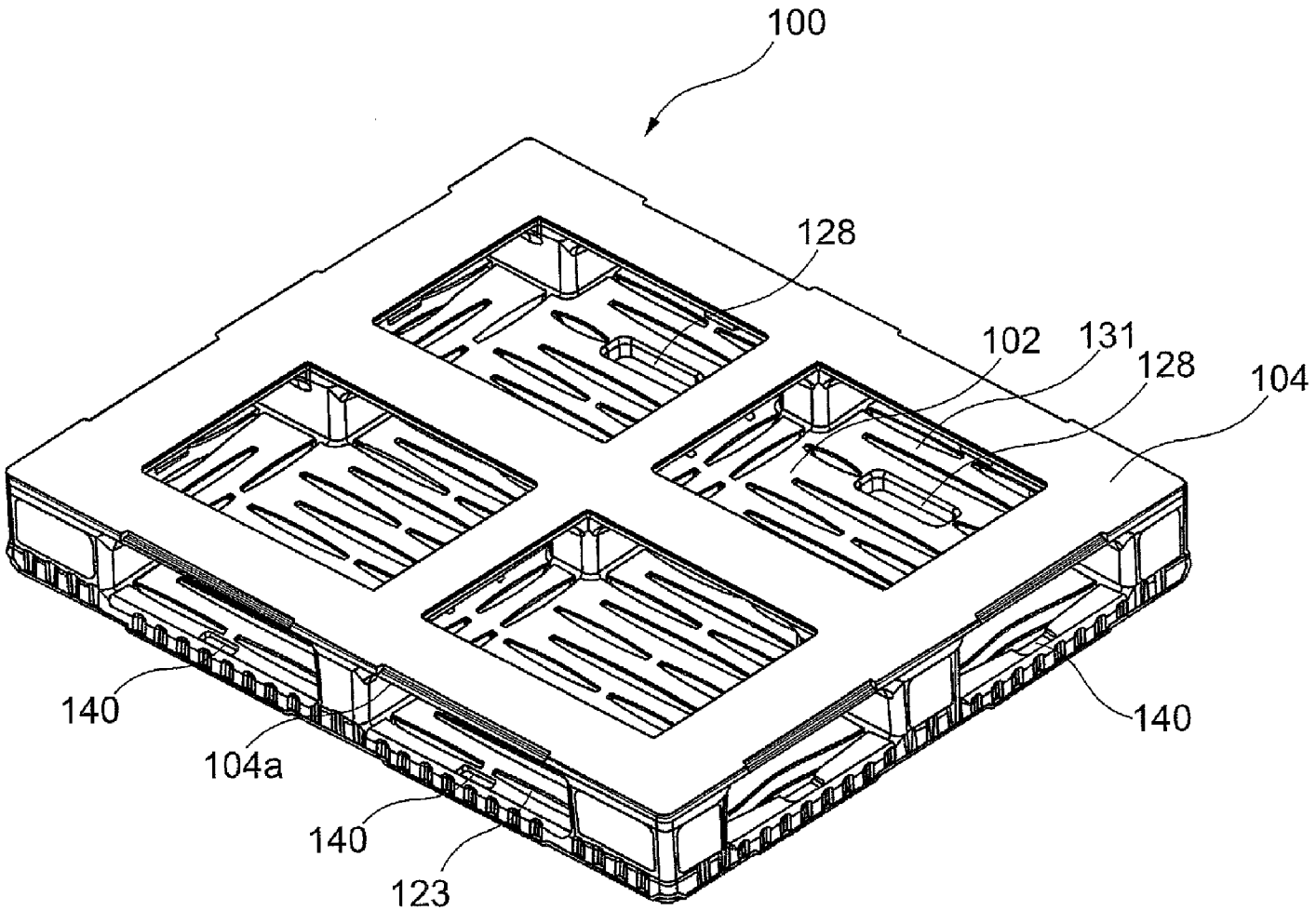
FIG. 22 is an underside perspective view of the pallet in FIG. 21.

As best shown in FIG. 22, similar to lower portion 4, lower portion 104 may be formed with openings 130, which may be large and may allow pallets 100 to be stacked on top of one another, while still providing ventilation between the pallets, similar to pallet 1.

Openings 128, 129, and 130 provide air circulation through the pallet to allow for the release of heat and combustible gases in the case of a fire, even when several pallets 100 are stacked on top of one another. Further, deck 102 is adapted to direct the flow of gases to slots 129 by locating the slots 129 in recesses 131 (FIG. 22) formed in the underside of deck 102. Because of heat release and gas flow through slots 129*a-d* as well as handholds 128, sprinklers in a facility in which pallets 100 are stored may be activated sooner than if the slots were not included. Further, openings 128,129 and 130 allow for water distribution through the pallet, such that water may drain through openings 128,129 and 130, as opposed to collecting between stacks of pallets and creating a turbulent impact, which may result in a flame breach in the pallets. Thus, any fire on or at pallet 100 may be more quickly controlled.

Referring to FIG. 22 lower portion 104 may chamfered at side edges 104*a* adjacent openings 123. The chamfered lower portion eases the pallets with a rim. Also as best seen in FIG. 22, the underside of top deck may include recesses 140 for securing a strap of a lid.

Figure 25B:
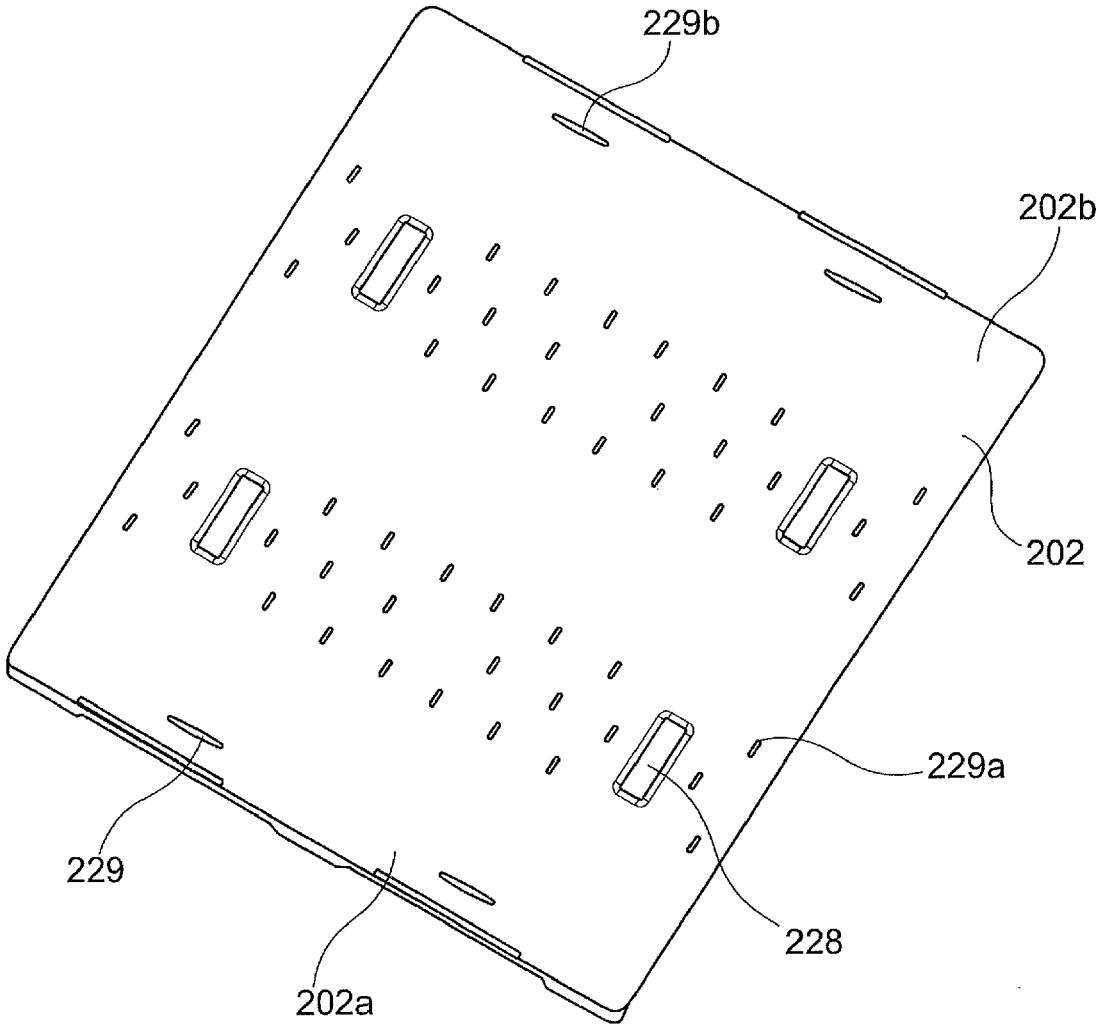
FIG. 25B is a top plan view of a pallet illustrating another embodiment of the venting pattern.
Figure 26:
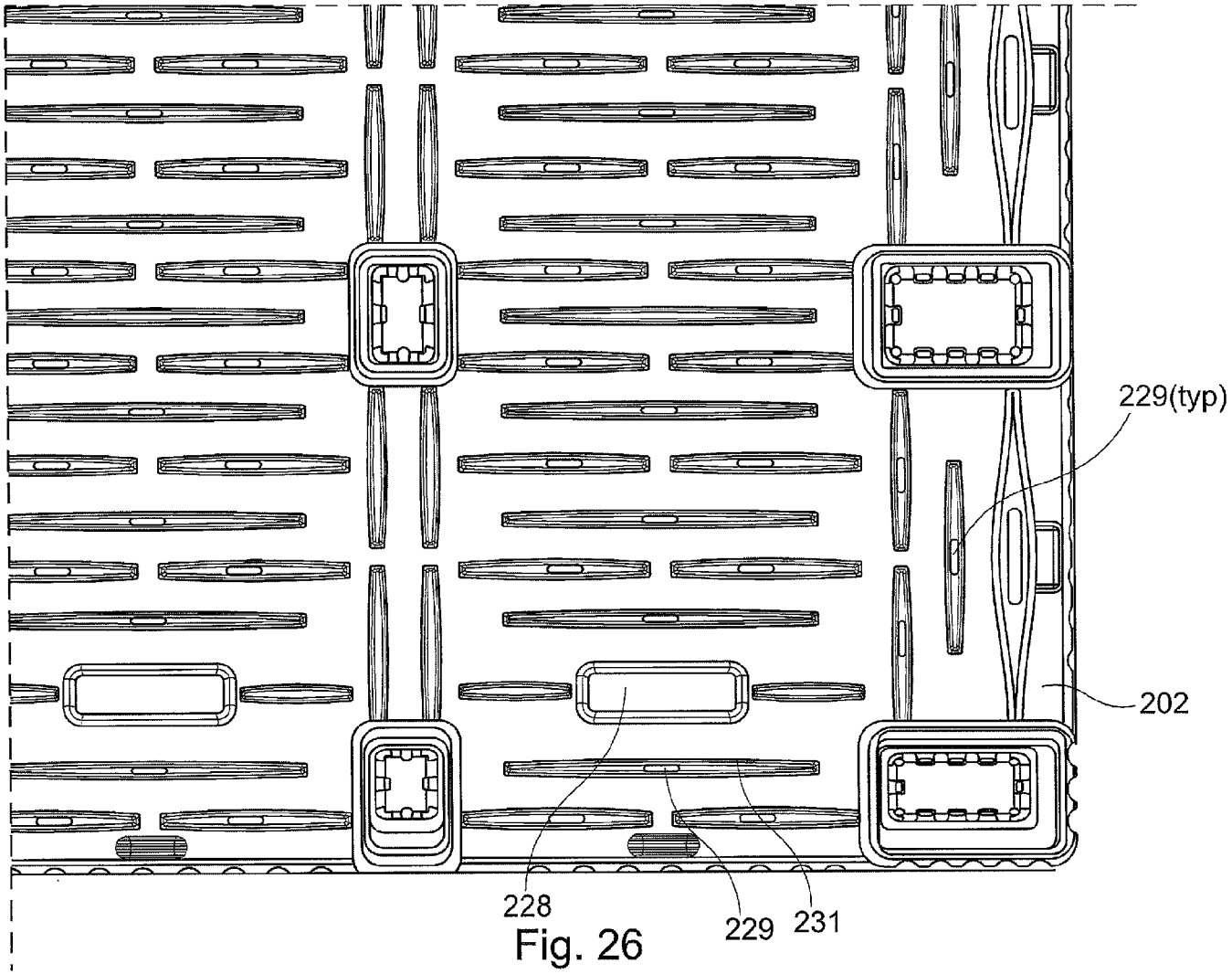
FIG. 26 is an enlarged view of the underside of the top deck of the pallet of FIG. 25B.

Referring to FIGS. 25B and 26, the numeral 200 designates another embodiment of the pallet of the present invention, which is of similar construction to pallet 100 and pallet 1. In the illustrated embodiment, the top deck of pallet 200 incorporates a modified opening pattern with a first plurality of slots 229*a*, which have generally uniform width and length, being arranged in parallel rows between handholds 228 and outer edge of top deck 202. A second plurality of slots 229*b* are arranged in generally parallel rows that are generally perpendicular to slots 229*a* and further that are located outside the pattern formed by slots 229*a* adjacent opposed edges 202*a* and 202*b* of top deck 202. Four additional slots 229*c* are provided with two adjacent each edge 202*a* and 202*b* between slots 229*b* and edges 202*a* and 202*b*.

Similar to top deck 202, the underside of top deck 202 incorporates a plurality of recesses 231 to direct the flow of gases to slots 229*a*, 229*b*, and 229*c*. Further, slots 229*a*, 229*b* and 229*c* may be located, including centrally located, in some of the recesses. The recesses are arranged in groups that are parallel to each other and in some groups that are perpendicular, with the recesses located at the perimeter being parallel to the edges of the top deck as best seen in FIG. 26.

The components of pallets 100 or 200 may be formed from any suitable material. For example, during the testing, the components were formed from a fire retardant High Density Polyethylene (HDPE) compound, which may be formed from plastic pellets or reground pallet components.

According to some embodiments, pallets 100 or 200 having the slots 128 and openings (128, 129, 130 and 228, 229, 230 described herein) are certified to comply with the requirements of the UL Standard 2335 "Fire Tests of Storage Pallets." To receive UL certification, the pallets were submitted to two series of tests. The first series evaluated the effectiveness of sprinkler protection on stacks of idle pallets. The second series of tests evaluated the fire hazard classification of Underwriters Laboratories (UL) 2335 test commodity on plastic pallets, which rank as a Class II fire hazard when tested with wood pallets. The test results demonstrate the ability of the fire retardant plastic material of the pallets to resist fire growth when water is applied to pallets positioned in common storage configurations.

The tested pallets 100 were four-way entry plastic pallets, having a length of approximately four feet, a width of approximately three feet four inches, and a height of approximately 5.5 inches. The average weight of the pallets was approximately 48-49 pounds.

With respect to the idle pallet series test, this test included one fire test, which was conducted with six, 12 foot high stacks of pallets positioned in a two wide by three long array, separated by a six inch longitudinal flue space. The test was conducted under a ceiling 30 feet high with 165 degrees Fahrenheit standard response sprinklers, installed in 10 by 10 foot spacing. The sprinkler system was controlled to supply a constant 0.60 gpm/ft$^2$ design density.

The pallets were ignited using four standard cellulose cotton igniters, each wrapped in a polyethylene bag and filled with eight ounces of gasoline. The igniters were ignited in the center of the array and the effectiveness of the sprinkler system was observed. Measurements during the tests included: i) number of operated sprinklers, ii) steel beam temperatures above the fire, and iii) flame spread through the pallet array. The test ran for 30 minutes.

Table 1 provides a summary of the results and the acceptance criteria for UL 2335:

In the second series of tests, three commodity storage tests were conducted with UL 2335 test commodity on plastic pallets. The test commodity, when used with a wood pallet, ranks a Class II Commodity, when tested in accordance with requirements defined herein. The purpose of the tests was to determine if the Commodity Classification Rank of the test commodity was increased by the use of plastic pallets in place of wood pallets.

The test commodity used in the commodity storage testing included two, tri-wall corrugated cartons, positioned one inside the other. The inner carton contains a five-sided, sheet-steel assembly, four sides and a top, and was centered within the inner carton such that there is a minimum amount of air space.

In each test, eight pallets were positioned beneath the test commodity and positioned in a two by two by two rack storage array below a heat release calorimeter. The commodities were ignited in the center flue space using four half-standard igniters, and water was applied to the resulting fire. The heat release rate of the fire was measured throughout each test, which continued for a period of 20 minutes.

The test results are based on a product rank that is calculated from four parameters: i) maximum one-minute average of the total heat release rate, ii) maximum one-minute average of the convective heat release rate, iii) effective convective heat release rate, defined as the average convective heat release rate measured over the five minutes of the most intense fire, and iv) the total convective energy measured over the ten minutes of most severe burning. Based on these parameters, pallets 100 had a mean total rank of 1.25, which meets the UL requirements for pallet certification.

Figure 27:
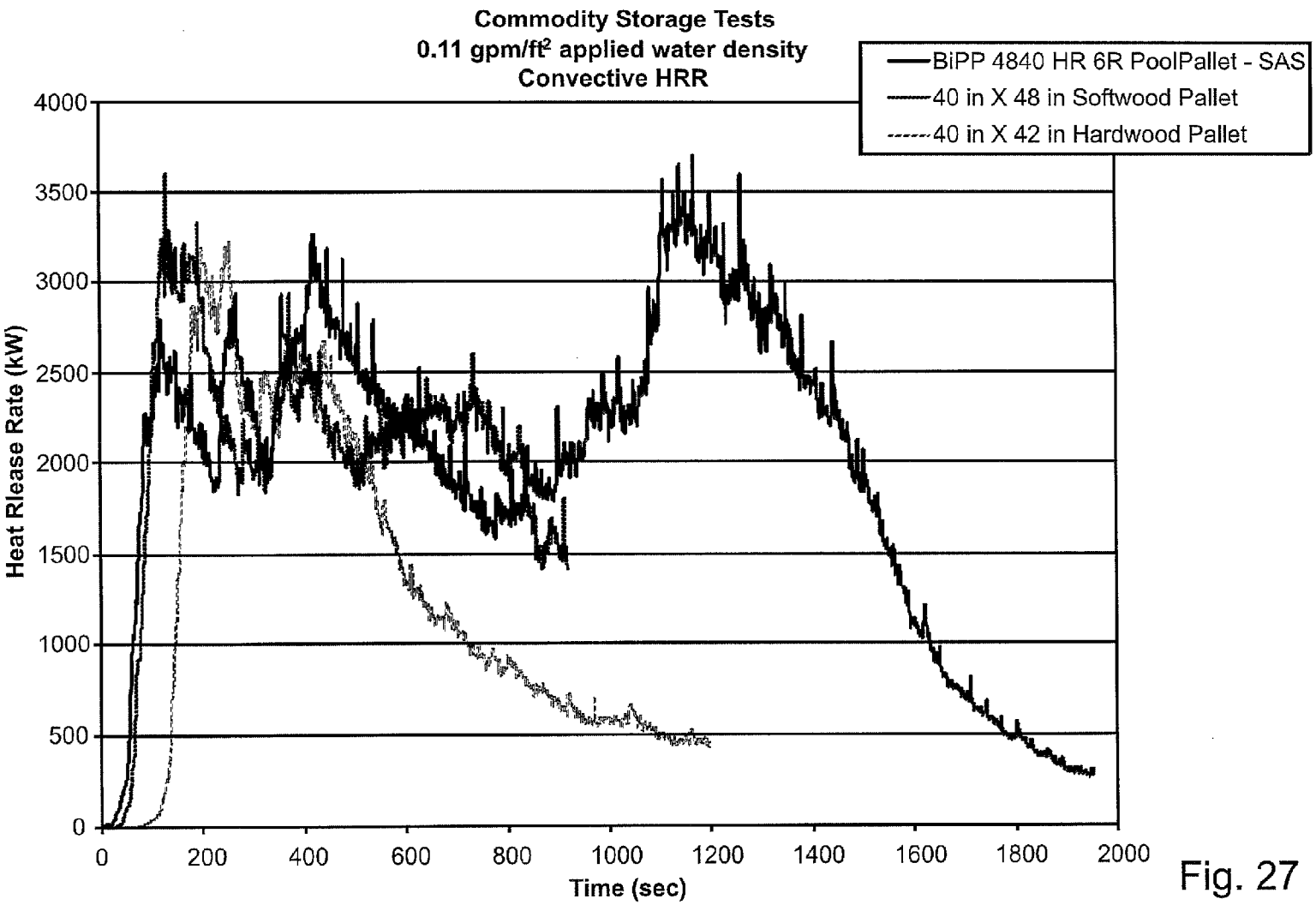
FIG. 27 is a graph of the test results for heat release rate verses time for a selected applied water density.
Figure 28:
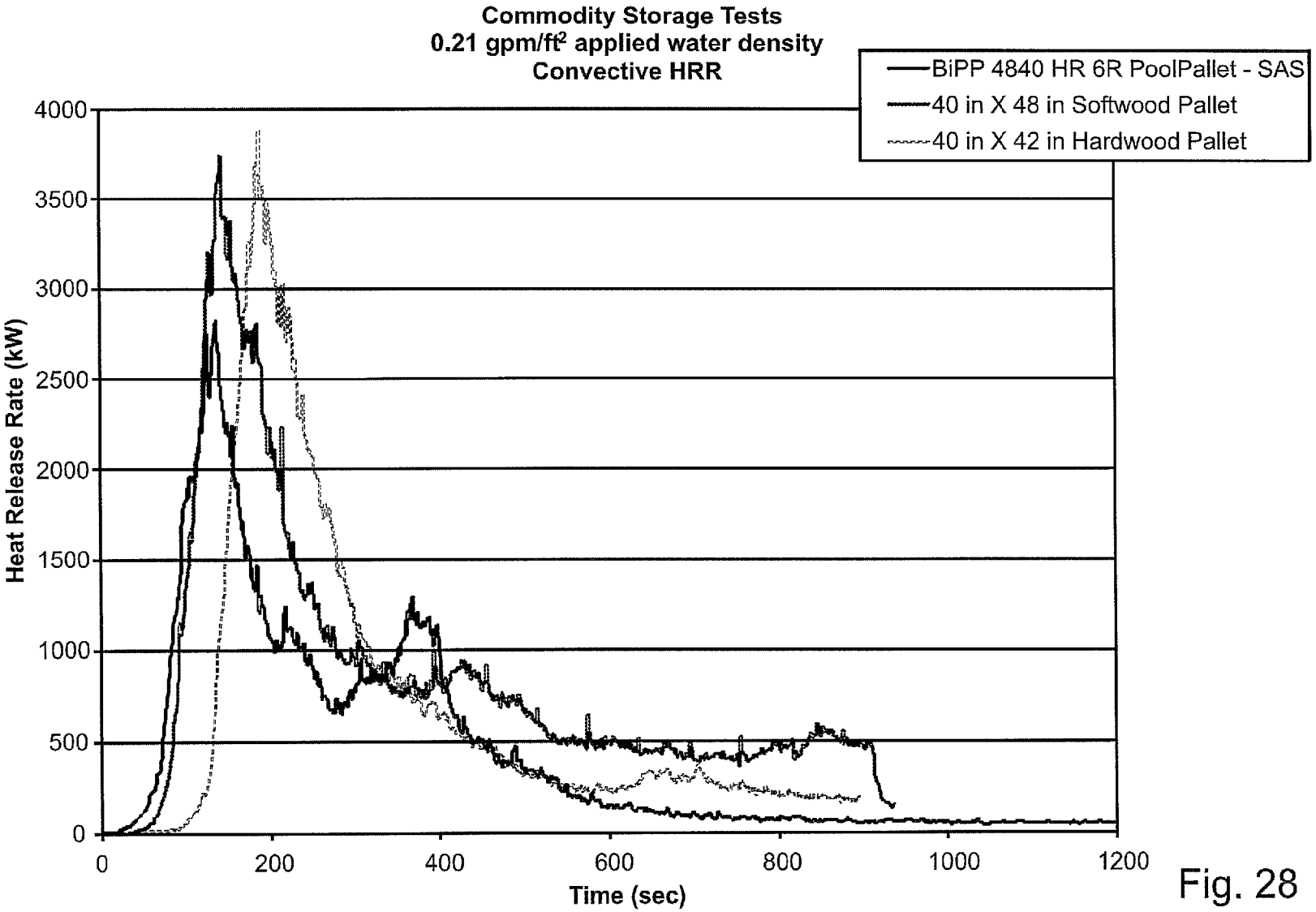
FIG. 28 is a similar graph to FIG. 27 illustrating the test results for same parameters for a higher applied water density.
Figure 29:
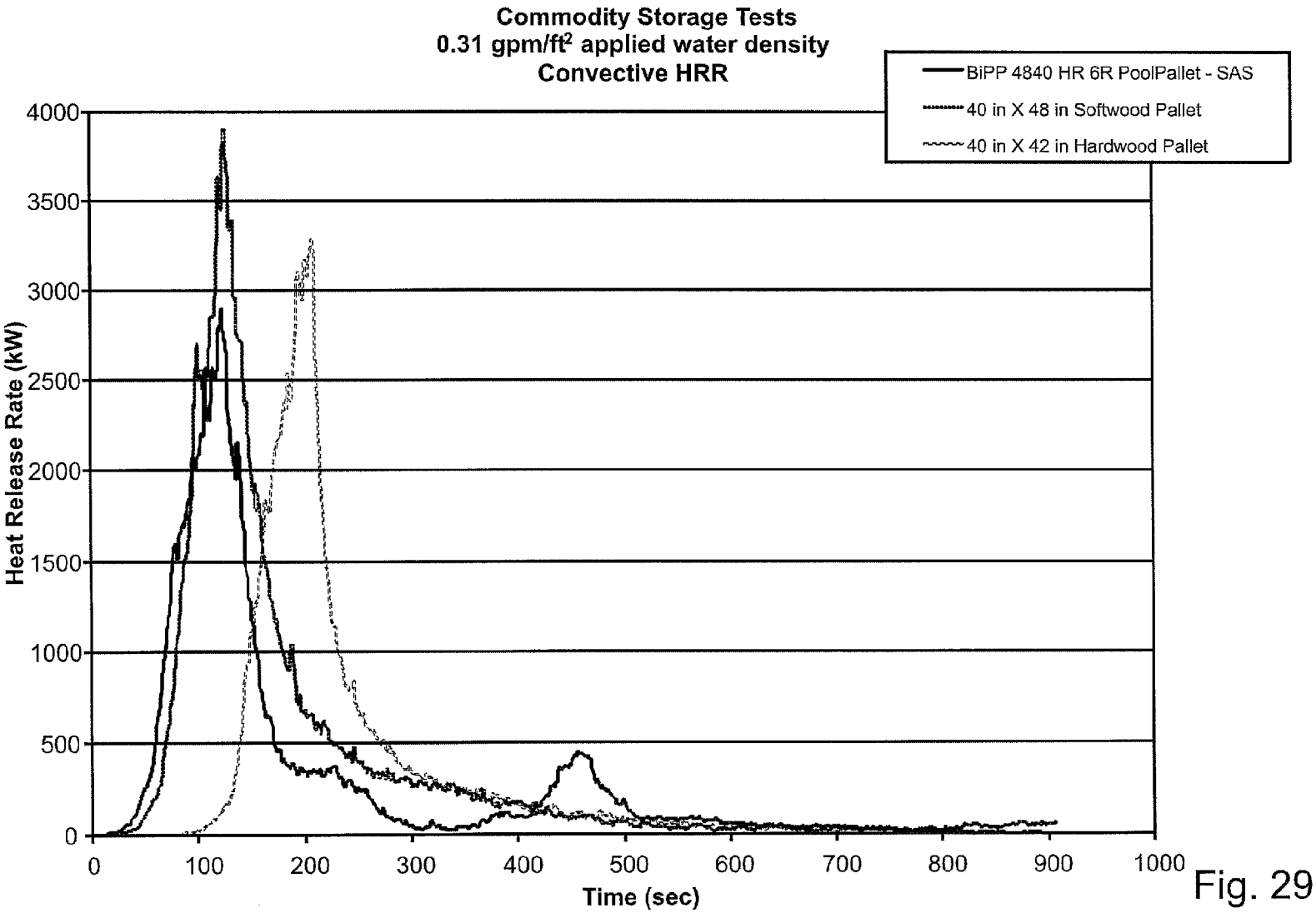
FIG. 29 is a similar graph to FIGS. 27 and 28 illustrating test results for the same parameters with an even higher applied water density.

Thus, the results of both the idle pallet test and the commodity storage testing of pallets 100 described above demonstrate that the four-way entry storage pallet met the acceptance criteria for the Underwriters Laboratories, Inc. Standard 2335 "Fire Tests of Storage Pallets." The results of the tests are illustrated in the graph in FIGS. 27-29.

Thus, the pallets according to the above-described embodiments are reusable and formed from heavy duty material adapted to be used in pallet pooling or circulating activities, or pallet rental activities. The pallets have a high torsional rigidity and are therefore adapted to support asymmetrical loads, as well as uniformly distributed loads, of at least 2800 pounds. The pallets may be formed from a fire retardant material, which may comprise a polymer, plastic or resin having a fire retardant additive. According to some embodiments, the pallets are certified by the UL Standard 2335 "Fire Tests of Storage Pallets."

TABLE 1

Idle Pallet Test Results

| Test No./ Test Date | Pallet Description | No. of Activated Sprinklers | Max. One Minute Avg. Steel Beam Temperature | Fire Spread to End of Array: Parallel to Longitudinal Flue | Fire Spread to End of Array: Perpendicular to Longitudinal Flue |
|---|---|---|---|---|---|
| 1 Jul. 5, 2007 | BiPP 4840 HR 6R PoolPallet-SAS | 4 | 131° F. | None before 7 minutes | None before 7 minutes |
| UL 2335 Acceptance Criteria | | 6 of less | Less Than 200° F. | Greater than 7 min | Greater than 7 min |

Thus, the pallets are compliant with each of the certification criteria in the idle pallet series test.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A pallet for the movement of goods, comprising:

an upper deck forming a loading part with a loading surface;

a frame section generally corresponding to the size of the loading surface and, at least at its corners, has spacers which point to the upper deck and have a material-fit connection to the upper deck; and wherein the upper deck includes an upper side forming said loading surface, an underside facing downwardly toward said frame section, the upper side of the upper deck having a planar surface with a plurality of transverse openings extending through the upper deck to provide air circulation through the pallet to allow for the release of heat and combustible gases in the case of a fire and to allow for water distribution through the pallet, and the underside of the upper deck forming a planar surface extending from one side of the upper deck to the other side of the upper deck, the planar surface of the underside having a plurality of recesses formed therein, said recesses extending into said planar surface from the underside but terminating before the loading surface of the upper deck, each recess having an outer perimeter, the openings being aligned in the recesses inwardly of the outer perimeters of the recesses wherein the openings are recessed in said planar surface of the underside of the upper deck in said recesses, and wherein the surfaces of the recesses surrounding the openings form channels in fluid communication with the openings for directing the flow of gas that flows across the planar surface to and through the openings to provide ventilation through the pallet.

2. The pallet in accordance with claim 1, wherein the openings comprise slots having a length greater than their widths.

3. The pallet in accordance with claim 2, wherein one group of the slots have greater lengths than other slots.

4. The pallet in accordance with claim 2, wherein one group of the slots have greater widths than other slots.

5. The pallet in accordance with claim 2, wherein the slots are arranged in first and second groups of slots, the first group of slots being arranged in a plurality of parallel rows, the second group of slots being arranged in a plurality of rows that are perpendicular to the rows of the first group of slots, and each of said recesses being elongated and having a greater length than its width and the length of its associated slot wherein the underside includes a first group of elongated recesses and a second group of recesses perpendicular to said first group of recesses such that the flow of gas is directed in both transverse directions.

6. The pallet in accordance with claim 5, wherein the first group of slots are arranged outside the second group of slots.

7. The pallet in accordance with claim 6, wherein the second group of slots has outermost slots, the first group of slots and the outermost slots forming a perimeter group of slots.

8. The pallet in accordance with claim 2, wherein the slots are arranged in first and second groups of parallel rows, which transverse the loading part from one side of the loading part to the other side of the loading part, and the slots being arranged in third, fourth, fifth and sixth groups of parallel rows that are arranged along the sides of the loading part orthogonal to the first and second groups of parallel rows.

9. The pallet in accordance with claim 1 wherein the openings are arranged in four groups with one group of openings in each quadrant of the upper deck.

10. The pallet in accordance with claim 1, the upper deck further having a plurality of handle openings.

11. The pallet in accordance with claim 10, wherein the plurality of openings are located between from the handle openings.

12. The pallet in accordance with claim 11, wherein the plurality of openings are located inwardly from the handle openings.

13. The pallet in accordance with claim 1, wherein the frame section includes a frame center section and a frame floor section, which have a material-fit connection to one another.

14. The pallet in accordance with claim 13, wherein the frame center section includes the spacers which point toward the upper deck and via which the frame center section is connected to the upper deck.

15. The pallet in accordance with claim 14, wherein the upper deck has a reinforcement section that has a material-fit connection with the loading part at their end faces.

16. The pallet in accordance with claim 15, wherein the spacers have elevations which are inwardly offset in steps.

17. The pallet in accordance with claim 1, wherein the upper deck and frame section are formed from one chosen from a plastic, a polymer and a resin.

18. The pallet in accordance with claim 17, wherein the upper deck and frame section are formed from a fire retardant material.

19. The pallet in accordance with claim 1, wherein each of said recesses has a length greater than its width, said recesses including first and second groups of recesses, said lengths of said first group of recesses being oriented to extend transversely across said underside, and said lengths of said second group of recesses being generally orthogonal to said first group of recesses wherein said recesses can direct the flow of gas in both transverse directions across said underside of said upper deck.

20. The pallet in accordance with claim 1, wherein said recesses have tapered distal ends.

21. The pallet in accordance with claim 1, wherein said frame section forms sides of said pallet and side openings at said sides, said recesses being oriented wherein the lengths of recesses extend transversely across said underside wherein the recesses form air passageways for directing the flow of gas across said planar surface of said underside and to and through the side openings to provide ventilation through the pallet.

* * * * *